US005272770A

United States Patent [19]

Allen et al.

[11] Patent Number: 5,272,770

[45] Date of Patent: Dec. 28, 1993

[54] HEAD RESTRAINING SYSTEM

[76] Inventors: Richard K. Allen, 6700 118th Ave. North; Richard D. Allen, 6700 118th Ave. N., both of Largo, Fla. 34643

[21] Appl. No.: 977,088

[22] Filed: Nov. 16, 1992

[51] Int. Cl.[5] ..... A41D 13/00; A42B 7/00

[52] U.S. Cl. ..... 2/2; 2/421; 280/290

[58] Field of Search ..... 2/2, 410, 421, 422, 2/425; 280/290; 297/465, 466, 484; 602/17

[56] References Cited

U.S. PATENT DOCUMENTS

| | | | |
|---|---|---|---|
| 3,134,106 | 5/1964 | Shaffer et al. | 2/425 |
| 3,148,375 | 9/1964 | Jones | 2/425 |
| 3,671,974 | 6/1972 | Sims | 2/425 |
| 3,818,509 | 6/1974 | Romo et al. | 2/425 |
| 3,873,996 | 4/1975 | Varteressian | 2/421 |
| 3,925,822 | 12/1975 | Sawyer | 2/421 |
| 4,638,510 | 1/1987 | Hubbard | 280/290 |
| 5,123,408 | 6/1992 | Gaines | 602/17 |

*Primary Examiner*—Clifford D. Crowder
*Assistant Examiner*—Michael A. Neas
*Attorney, Agent, or Firm*—Harold D. Shall

[57] ABSTRACT

A head restraining system including a helmet having a chin protector formed thereon, a keeper plate overlying the shoulders, upper chest, including the sternum area, and upper back of the driver, a plurality of straps connecting the shoulder, chest and back portion of the keeper plate to aligned portions of the helmet and a pair of shoulder straps securing the keeper plate to the driver.

3 Claims, 2 Drawing Sheets

HEAD RESTRAINING SYSTEM

BACKGROUND OF THE INVENTION

1. Field of the Invention

This invention relates generally to systems for restraining movement of a race drivers head and more particularly to a racing helmet with a harness used in conjunction with the conventional shoulder harness to limit excessive movement of the driver's head caused by, for example, centrifugal forces, acceleration and deceleration, impact and the jolting caused by the vehicle's contact with the racing surface.

2. State of the Prior Art

There are many different types of devices for securing helmets on the heads of persons, but these are mainly for football players or as shown in U.S. Pat. No. 3,925,822, for use by motorcycle drivers and do not afford the freedom of movement or the restraint of the present device which incorporates the vehicles shoulder harness. The device of U.S. Pat. No. 3,925,822 is used for securing helmets on the heads of motorcycle drivers and will not limit movement of the driver's head as will the device of the present invention.

SUMMARY OF THE INVENTION

The present invention incorporates a racing driver's helmet, having the conventional chin protector formed thereon, a keeper plate, straps from the helmet to the keeper plate and the vehicles shoulder harness which secures the keeper plate on the driver's shoulders, chest and back. The keeper plate is a semi-rigid plate made of plastic, preferably a fire retardant plastic such as KYDEX (TM) which is a blend of acrylic and PVC made by the Kleerdex Company of Mt. Laurel, N.J., worn over the shoulder and around the neck and extending several inches down the back in the rear, downward over the sternum area of the chest in the front and over the shoulder on each side. There are four anchoring points on the keeper plate, a front anchor point in the lower center of the chest area, a rear anchor point in the center of the back area and one anchor point on each shoulder area near the outside edge of the keeper plate. These anchor points are formed with "D-rings" thereon.

There are four anchor points on the drivers helmet; one on each side in the vicinity of the ear location, one in the lower center of the back, and one in the center of the helmet's chin protector. Nylon straps made of seat belt grade nylon are secured at their distal end to each of the anchoring points on the keeper plate while the proximal end of each strap carries a quickly adjustable buckle and a snap hook with the snap hook being attached to the registering D-ring on helmet.

The keeper plate is placed over the wearer's shoulders, chest and back and the shoulder straps of a conventional five point racing harness are placed over the keeper plate between the anchor points on the shoulder portion of the keeper plate and the inner edge of keeper plate to secure the keeper plate to the wearing driver. When the racing harness is in place, the keeper plate is held in place by the shoulder straps. Forces of motion which cause the driver to be restrained by the shoulder straps also cause the keeper plate to be tightened to the wearer thereby creating a stable anchoring platform to restrain unwanted helmet movement and thereby driver's head movement.

DESCRIPTION OF THE PREFERRED EMBODIMENT

Figure 2:
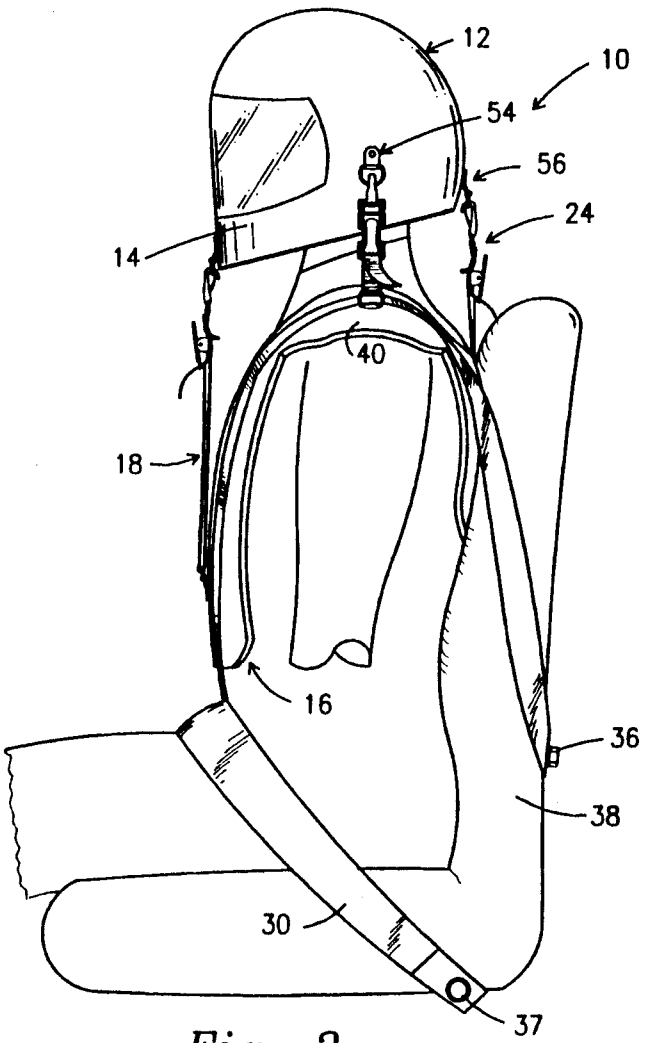
FIG. 2 is a left side elevational view of the invention as shown in FIG. 1 showing the driver in the drivers seat.
Figure 1:
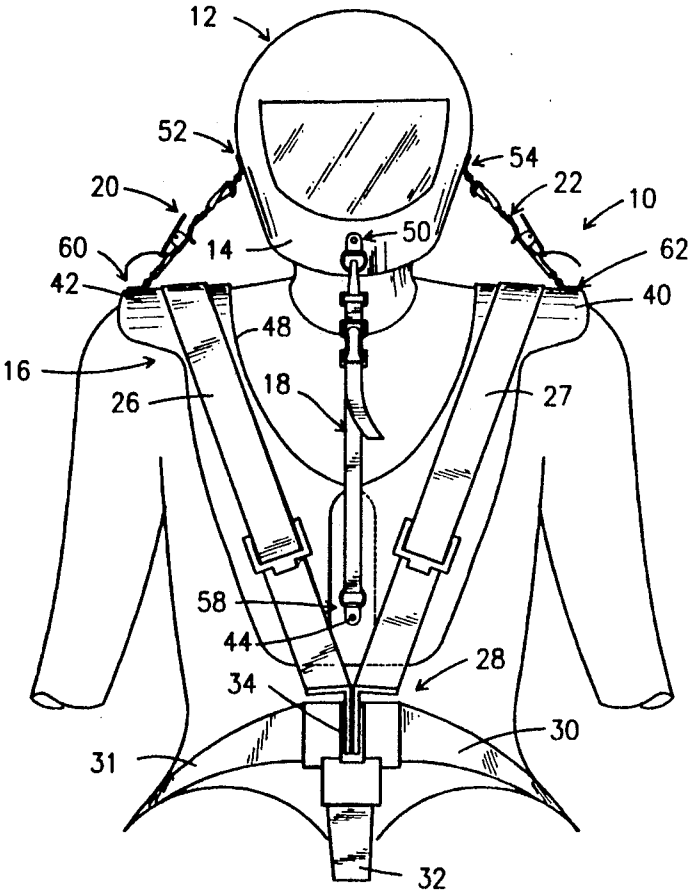
FIG. 1 is a frontal elevational view of the invention mounted on a driver with the seat omitted.
Figure 3:
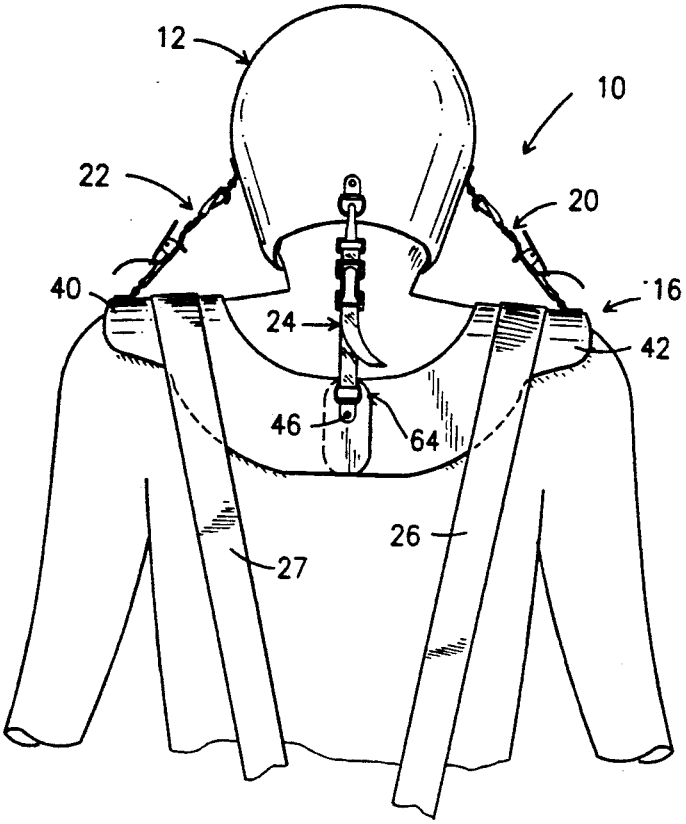
FIG. 3 is a rear elevational view of the invention mounted on a driver with the seat omitted.

Referring now to the drawings and more particularly to FIGS. 1-3, a head restraining system is shown generally at 10 and includes a helmet 12, having a chin protector portion 14 (and the usual chin strap not shown), a keeper plate assembly 16, straps as follows; a front securing strap 18, left and right securing straps 20 and 22, respectively, and a rear securing strap 24, and also includes a pair of shoulder straps 26 and 27 of a conventional five point racing harness shown generally at 28. The details of the securing straps will be explained hereinafter. The racing harness not only includes the shoulder straps 26 and 27, which could be formed separately from the rest of the harness, but also includes a pair of lap belts 30 and 31 and an anti-submarine belt 32, which straps and belts are secured at a central buckle 34 in a well known manner.

The ends of the shoulder straps 26 and 27 distal of the buckle 34 are shown as being secured at 36 to the rear of the driver's seat 38; however other locations of securing the distal ends of the shoulder straps are well known and will be operative for this invention. The distal ends of the lap belt 30 (and also the distal end of the belt 31 (not shown) are also secured at 37 to the seat 38; however, other locations of securing the distal ends of the lap belts are well known. The distal end of the anti-submarine belt 32 (not shown) is also suitable secured to the vehicle in a well known manner.

The keeper plate assembly 16 is made from a left half 40 which overlies the driver's left shoulder and right half 42 which overlies the driver's right shoulder. The two halves are made from a fire-retardant semi-rigid plastic such as KYDEX as hereinbefore described. The two halves 40 and 42 are pivotally connected in front by a rivet 44 and pivotally connected in the rear by a rivet 46. The plate assembly 16 is cut out centrally at 48 with an opening large enough to receive the drivers head; it should be noted that the two halves 40 and 42 can be pivoted so as to enlarge the opening to receive the driver's head, with such pivoting also serving to make the assembly 16 adjustable to fit different head sizes and should widths. Once placed over the drivers head, the keeper plate 16 is held securely to the drivers shoulders by the buckled shoulder straps 26 and 27 which pass thereover and press securely thereagainst. Forces of motion on the wearer that causes the wearer to be restrained by the shoulder harness also causes the keeper plate 16 to be tightened to the wearer which creates a stable anchoring platform to restrain unwanted helmet movement.

Four hook tabs are riveted to the helmet 12; a front hook tab 50 on the chin protecting portion, a right hook tab 52 in the vicinity of the right ear of the driver, a left hook tab 54 in the vicinity of the left ear of the driver and a rear hook tab 56 in the lower center of the back of the helmet.

A hook tab 58 is secured by the rivet 44 to the chest portion of the keeper plate assembly 16 at the lower medial portion thereof, a hook tab 60 is riveted to the keeper plate assembly on the right shoulder portion thereof near the right outer edge of the assembly, a hook tab 62 is riveted to the keeper plate assembly on the left outer edge of the assembly, while a hook tab 64 is riveted to the rear of the keeper plate assembly by the rivet 46. The location of the shoulder hook tabs 60 and 62 are such that the shoulder straps 26 and 27 can pass over the keeper plate assembly, 16 and between the tabs 60 and 62 and the wearer's head opening in the plate assembly.

Figure 6:
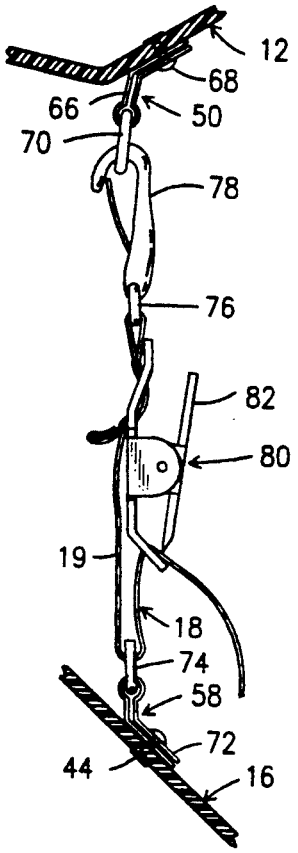
FIG. 6 is an enlarged side elevational view of an anchoring strap, showing a fragment of the attached helmet and keeper plate.
Figure 4:
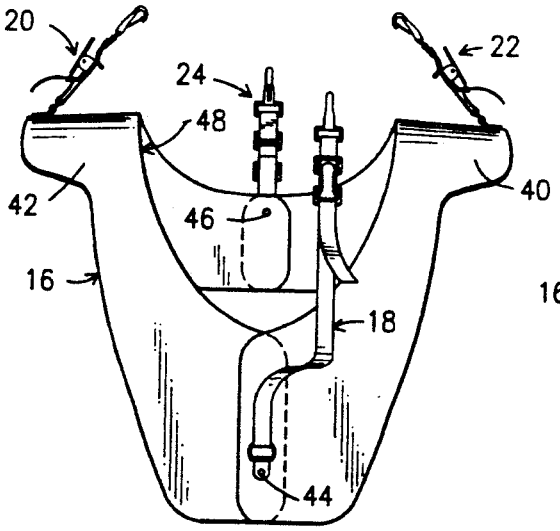
FIG. 4 is a front elevational view of a keeper plate and anchoring straps.

Referring now to FIG. 6 which shows in detail the structure of the securing strap 18 and the hook tabs 50 and 58, such is also illustrative of the securing straps 20, 22 and 24 and the hook tabs cooperating therewith. The hook tab 50 includes a bracket 66 riveted to the helmet 12 by a rivet 68, to which bracket is secured a D-ring 70. The hook tab 58 includes a bracket 72 riveted to the keeper assembly 16 by the rivet 44, to which bracket is secured a D-ring 74. The strap portion 19 of the securing strap 18 passes at its top end through a D-ring 76 of a snap hook 78, the latter being snapped to the D-ring 70 of the hook tab 50, and then the strap 19 passes through a pair of securing slots (not shown) in the top end of an adjusting clip 80. The strap 19 then extends downwardly and passes through the D-ring 74 and then extends upwardly and passes through and is secured to the adjusting clip 80 by a spring loaded lever 82 of the adjusting clip 80.

Figure 5:
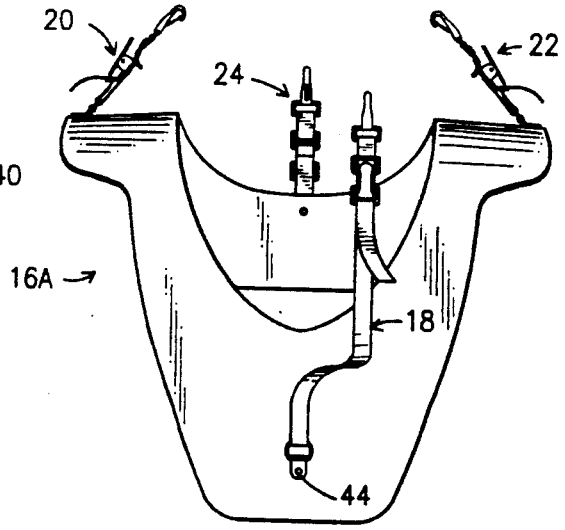
FIG. 5 is a view like FIG. 4 of another type of keeper plate with anchoring straps thereon.

Referring now to FIG. 5, another embodiment of a keeper plate assembly is shown at 16A end is of one piece construction while still being made of a fire-retardant semi-rigid plastic such as the aforementioned KYDEX. This keeper assembly 16A will work as well as the assembly 16 but is not adjustable to fit over various head sizes or for various shoulder widths.

In accordance with the provision of the patent statutes, the principal and mode of operation of the invention have been described and illustrated in its preferred embodiments. However, it must be understood that the invention can be practiced otherwise than as specifically illustrated and described without departing from its spirit or scope.

What is claimed is:

1. A head restraining system for restraining movement of a race car driver's head comprising in combination, (a) a racing helmet including a chin protecting portion of the helmet formed in the lower front portion of the helmet; (b) a keeper plate means for overlying the shoulders, chest and upper back of the driver and having a central opening for receiving the drivers head; (c) a first keeper plate securing means formed on the keeper plate means at a location in the vicinity of the driver's sternum; (d) a second keeper plate securing means formed on the keeper plate means at a location in the vicinity of the outer portion overlying the driver's right shoulder; (e) a third keeper plate securing means formed on the keeper plate means at a location in the vicinity of the outer portion overlying the drivers left shoulder; (f) a fourth keeper plate securing means formed on the keeper plate means at a location in the middle thereof overlying the driver's back; (g) a first helmet securing means formed on the chin protecting portion of the helmet; (h) a second helmet securing means formed on the helmet at the location overlying the drivers right ear; (i) a third helmet securing means formed on the helmet at the location overlying the divers left ear; (j) a fourth helmet securing means formed medially in the rear lower portion of said helmet; (k) a first, second, third and fourth strap means connecting said first, second, third and fourth keeper plate securing means respectively to said first, second, third and fourth helmet securing means; (l) and a first and second shoulder strap means secured to the race car carrying the driver with said first shoulder strap means overlying the right shoulder portion of said keeper plate means at a position between said second keeper plate securing means and the central opening therein and said second shoulder strap means overlying the left shoulder portion of said keeper plate means at a position between said third keeper plate securing means and the central opening therein.

2. A head restraining system according to claim 1 wherein said keeper plate means is formed of a left and a right half, which halves are pivotally and securedly interconnected.

3. A head restraining system according to claim 1 wherein said keeper plate means is of one piece construction.

* * * * *